US012152836B2

(12) United States Patent
Alahyari et al.

(10) Patent No.: US 12,152,836 B2
(45) Date of Patent: Nov. 26, 2024

(54) HEAT RECOVERY VENTILATOR

(71) Applicant: Carrier Corporation, Palm Beach Gardens, FL (US)

(72) Inventors: Abbas A. Alahyari, Glastonbury, CT (US); Dhruv Chanakya Hoysall, West Hartford, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/734,641

(22) PCT Filed: Sep. 17, 2019

(86) PCT No.: PCT/US2019/051440

§ 371 (c)(1),
(2) Date: Dec. 3, 2020

(87) PCT Pub. No.: WO2020/060995

PCT Pub. Date: Mar. 26, 2020

(65) Prior Publication Data

US 2021/0199387 A1 Jul. 1, 2021

Related U.S. Application Data

(60) Provisional application No. 62/733,249, filed on Sep. 19, 2018.

(51) Int. Cl.

| | |
|---|---|
| ***F28D 19/04*** | (2006.01) |
| ***F24F 12/00*** | (2006.01) |
| ***F28F 13/12*** | (2006.01) |

(52) U.S. Cl.

CPC ..... *F28D 19/042* (2013.01); *F28F 13/12* (2013.01); *F24F 12/00* (2013.01); *F28F 2245/02* (2013.01); *F28F 2245/04* (2013.01)

(58) Field of Classification Search

CPC . F23L 15/02; F02C 7/105; F23G 7/068; F24F 2203/10; F24F 2203/104;

(Continued)

(56) References Cited

U.S. PATENT DOCUMENTS 1,586,816 A * 6/1926 Ljungstrom ..... F28D 19/04 165/5
2,313,081 A 3/1943 Ljungstrom et al.

(Continued)

FOREIGN PATENT DOCUMENTS

DE 1451156 A1 2/1969
GB 1536250 A 12/1978

(Continued)

OTHER PUBLICATIONS

International Preliminary Report on Patentability; International Application No. PCT/US2019/051440; International Filing Date: Sep. 17, 2019; Date of Issuance: Mar. 23, 2021; 7 pages.

(Continued)

*Primary Examiner* — Tavia Sullens
*Assistant Examiner* — Khaled Ahmed Ali Al Samiri
(74) *Attorney, Agent, or Firm* — CANTOR COLBURN LLP

(57) ABSTRACT

A heat recovery wheel for a heat exchanger includes a wheel rim defining an outer perimeter of the heat recovery wheel, and a plurality of wheel passages located between the wheel rim and the wheel axis. The plurality of wheel passages are at least partially defined by one or more passage fins. At least a portion of a passage fin of the plurality of passage fins extends non-parallel to the wheel axis between a first wheel end and a second wheel end. The plurality of wheel passages are configured for flow of a first airflow and a second airflow therethrough for thermal energy exchange between the first airflow and the second airflow.

6 Claims, 4 Drawing Sheets

(58) Field of Classification Search
CPC ..... F24F 2203/1048; F24F 2203/1068; F24F 12/006; F24F 12/00; F28D 19/04; F28D 19/041; F28D 19/042; F28D 19/044; F28D 19/045; F28D 19/047; F28D 19/048; F28F 2245/02; F28F 2245/04; F28F 13/12
See application file for complete search history.

(56) References Cited

U.S. PATENT DOCUMENTS

| | | | | |
|---|---|---|---|---|
| 2,713,728 | A * | 7/1955 | Cassells | F26B 11/024 34/135 |
| 3,463,222 | A * | 8/1969 | Grames | F28F 3/04 165/DIG. 42 |
| 4,013,117 | A * | 3/1977 | Kopetzki | B23P 11/00 29/445 |
| 4,125,149 | A | 11/1978 | Kritzler et al. | |
| 4,432,409 | A | 2/1984 | Steele | |
| 5,183,098 | A | 2/1993 | Chagnot | |
| 5,485,877 | A | 1/1996 | Brophy | |
| 5,765,630 | A | 6/1998 | Bloomer | |
| 5,771,707 | A | 6/1998 | Lagace et al. | |
| 5,878,590 | A * | 3/1999 | Kadle | F24F 3/1423 62/271 |
| 6,019,160 | A | 2/2000 | Chen | |
| 6,179,276 | B1 | 1/2001 | Chen et al. | |
| 7,886,986 | B2 | 2/2011 | Fischer, Jr. et al. | |
| 8,020,298 | B2 | 9/2011 | Campbell et al. | |
| 8,590,606 | B2 | 11/2013 | Arai et al. | |
| 9,404,689 | B2 | 8/2016 | Hakbijl et al. | |
| 9,874,408 | B2 | 1/2018 | Quesada Saborio | |
| 9,950,133 | B2 | 4/2018 | Umehara et al. | |
| 2007/0125528 | A1 | 6/2007 | Fakheri | |
| 2007/0272396 | A1 | 11/2007 | Campbell et al. | |
| 2017/0102193 | A1 | 4/2017 | Atkinson et al. | |

FOREIGN PATENT DOCUMENTS

| | | | |
|---|---|---|---|
| WO | 2007012874 | A1 | 2/2007 |
| WO | 2012166750 | A1 | 12/2012 |

OTHER PUBLICATIONS

International Search Report for International Application No. PCT/US2019/051440; International Filing Date: Sep. 17, 2019; Date of Mailing: Nov. 26, 2019; 6 pages.

Written Opinion for International Application No. PCT/US2019/051440; International Filing Date: Sep. 17, 2019; Date of Mailing: Nov. 26, 2019; 8 pages.

* cited by examiner

HEAT RECOVERY VENTILATOR

CROSS REFERENCE TO RELATED APPLICATIONS

This application is a National Stage application of PCT/US2019/51440, filed Sep. 17, 2019, which claims the benefit of Provisional Application No. 62/733,249 filed Sep. 19, 2018, the disclosures of which are incorporated herein by reference in their entirety.

BACKGROUND

Exemplary embodiments pertain to the art of heat exchangers, and more particularly to rotary wheel heat recovery ventilators.

Heat exchangers are utilized in ventilation systems installed in, for example, residential, commercial and industrial spaces to extract and remove heat and/or moisture from one airstream and transfer that heat energy and/or moisture to a second airstream. In particular, rotary wheel heat exchangers, or heat recovery ventilators, are known wherein a wheel rotates in a housing through countervailing streams of exhaust and fresh air, in the winter extracting heat and moisture from the exhaust stream and transferring it to the fresh air stream. In the summer rotary wheel heat exchangers extract heat and moisture from the fresh air stream and transfer it to the exhaust stream, preserving building air conditioning while providing desired ventilation.

Heat transfer enhanced heat recovery wheels present an opportunity for the development of significantly more compact designs of ventilation systems, reducing material and fabrication cost. However, a number of challenges exist for the application of new designs: Wheel effectiveness, pressure drop, material cost and design complexity are some of the key challenges.

BRIEF DESCRIPTION

In one embodiment, a heat exchanger includes a housing, the housing defining a first airflow chamber through which a first airflow is directed and a second airflow chamber through which a second airflow is directed. A heat recovery wheel is located in the housing and is rotatable about a wheel axis. The heat recovery wheel includes a wheel rim defining an outer perimeter of the heat recovery wheel, and a plurality of wheel passages located between the wheel rim and the wheel axis. The plurality of wheel passages are at least partially defined by one or more passage fins. At least a portion of a passage fin of the plurality of passage fins extends non-parallel to the wheel axis between a first wheel end of the heat recovery wheel and a second wheel end of the heat recovery wheel. The plurality of wheel passages are configured for flow of the first airflow and the second airflow therethrough for thermal energy exchange between the first airflow and the second airflow.

Additionally or alternatively, in this or other embodiments the at least one passage fin extends linearly non-parallel to the wheel axis from the first wheel end to the second wheel end.

Additionally or alternatively, in this or other embodiments the at least one passage fin extends in a chevron shape from the first wheel end to the second wheel end.

Additionally or alternatively, in this or other embodiments the at least one passage fin includes a first fin portion extending from the first wheel end parallel to the wheel axis, a second fin portion extending from the second wheel end parallel to the wheel axis, circumferentially offset from the first fin portion, and a third fin portion connecting the first fin portion to the second fin portion. The third fin portion is non-parallel to the wheel axis.

Additionally or alternatively, in this or other embodiments circumferentially adjacent passage fins are non-parallel.

Additionally or alternatively, in this or other embodiments the at least one passage fin is discontinuous between the first wheel end and the second wheel end.

Additionally or alternatively, in this or other embodiments the plurality of wheel passages are arranged in a plurality of layers from the wheel axis to the wheel rim.

Additionally or alternatively, in this or other embodiments a parting sheet separates radially adjacent layers of the plurality of layers.

In another embodiment, a heat recovery wheel for a heat exchanger includes a wheel rim defining an outer perimeter of the heat recovery wheel, and a plurality of wheel passages located between the wheel rim and the wheel axis. The plurality of wheel passages are at least partially defined by one or more passage fins. At least a portion of a passage fin of the plurality of passage fins extends non-parallel to the wheel axis between a first wheel end and a second wheel end. The plurality of wheel passages are configured for flow of a first airflow and a second airflow therethrough for thermal energy exchange between the first airflow and the second airflow.

Additionally or alternatively, in this or other embodiments the at least one passage fin extends linearly non-parallel to the wheel axis from the first wheel end to the second wheel end.

Additionally or alternatively, in this or other embodiments the at least one passage fin extends in a chevron shape from the first wheel end to the second wheel end.

Additionally or alternatively, in this or other embodiments the at least one passage fin includes a first fin portion extending from the first wheel end parallel to the wheel axis, a second fin portion extending from the second wheel end parallel to the wheel axis, circumferentially offset from the first fin portion, and a third fin portion connecting the first fin portion to the second fin portion, the third fin portion non-parallel to the wheel axis.

Additionally or alternatively, in this or other embodiments circumferentially adjacent passage fins are non-parallel.

Additionally or alternatively, in this or other embodiments the at least one passage fin is discontinuous between the first wheel end and the second wheel end.

Additionally or alternatively, in this or other embodiments the plurality of wheel passages are arranged in a plurality of layers from the wheel axis to the wheel rim.

Additionally or alternatively, in this or other embodiments a parting sheet separates radially adjacent layers of the plurality of layers.

Additionally or alternatively, in this or other embodiments passage fins of radially adjacent layers of the plurality of layers are non-parallel.

Additionally or alternatively, in this or other embodiments the plurality of passage fins are textured to enhance thermal energy transfer.

Additionally or alternatively, in this or other embodiments the plurality of passage fins are coated with one or more of an adsorbant, a hydrophobic coating or a hydrophilic coating.

Additionally or alternatively, in this or other embodiments the plurality of passage fins are formed from a metal, a polymer or a composite material.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
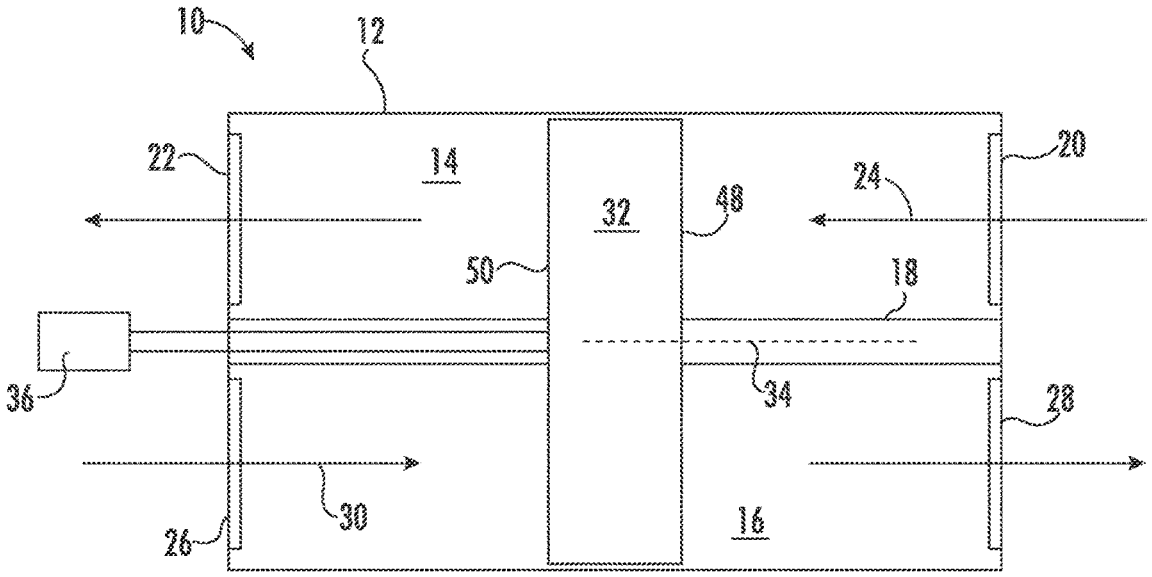
FIG. 1 is a schematic view of an embodiment of a heat recovery ventilator.
Figure 2:
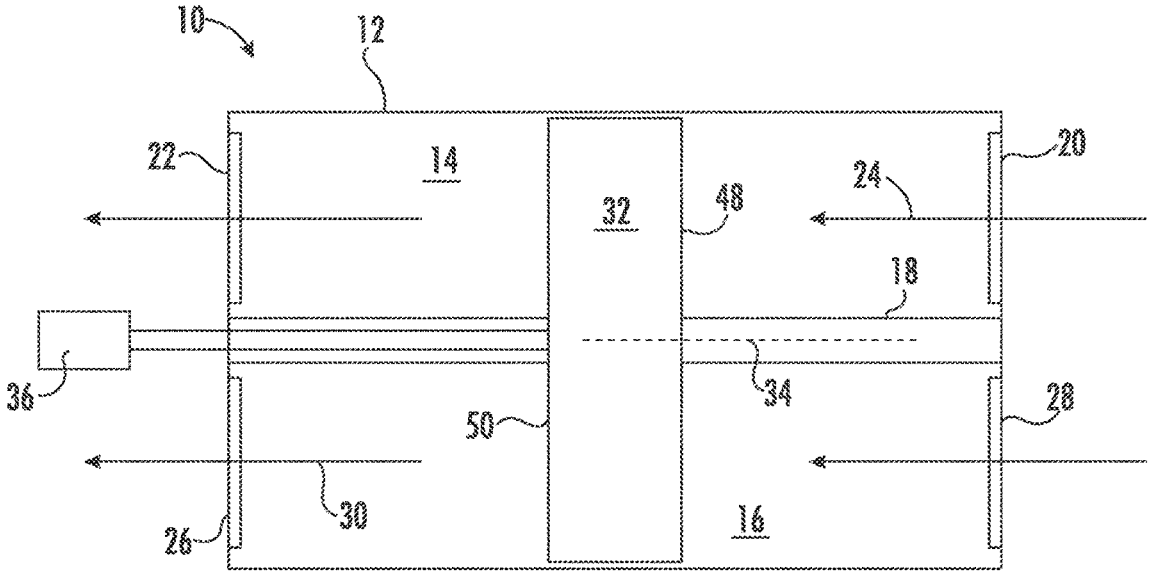
FIG. 2 is a schematic view of another embodiment of a heat recovery ventilator.

Referring now to FIG. 1, illustrated is a schematic view of an embodiment of a heat recovery ventilator 10. The heat recovery ventilator 10 includes a housing 12 having a first airflow chamber 14 and a second airflow chamber 16. In some embodiments, the first airflow chamber 14 and the second airflow chamber 16 are separated by an internal housing wall 18. The first airflow chamber 14 includes a first inlet port 20 and a first outlet port 22, through which a first airflow 24 is directed through the first airflow chamber 14. Similarly, the second airflow chamber 16 includes a second inlet port 26 and a second outlet port 28, through which a second airflow 30 is directed through the second airflow chamber 16. In some embodiments, the first airflow 24 is, for example, a return airflow from a conditioned or ventilated space, while the second airflow 30 is, for example, a fresh airflow. In the embodiment of FIG. 1, the first airflow 24 and the second airflow 30 are directed through the first airflow chamber 14 and the second airflow chamber 16, respectively, in opposite directions, while in another embodiment, such as schematically illustrated in FIG. 2, the first airflow 14 and the second airflow 16 are directed through the first airflow chamber 14 and the second airflow chamber 16, respectively, in the same direction.

Referring again to FIG. 1, a heat recovery wheel 32 is located in the housing 12 and is configured to rotate about a wheel axis 34. The heat recovery wheel 32 rotates continuously about the wheel axis 34, and in some embodiments is driven by a wheel motor 36 operably connected to the heat recovery wheel 32 by, for example, a shaft or belt. With the heat recovery wheel 32 rotating, the first airflow 24 and the second airflow 30 flow through a plurality of wheel passages 38 (shown in FIG. 3) in the heat recovery wheel 32. Thermal energy is transferred between the first airflow 24 and the second airflow 30 via the heat recovery wheel 32 structure.

Figure 3:
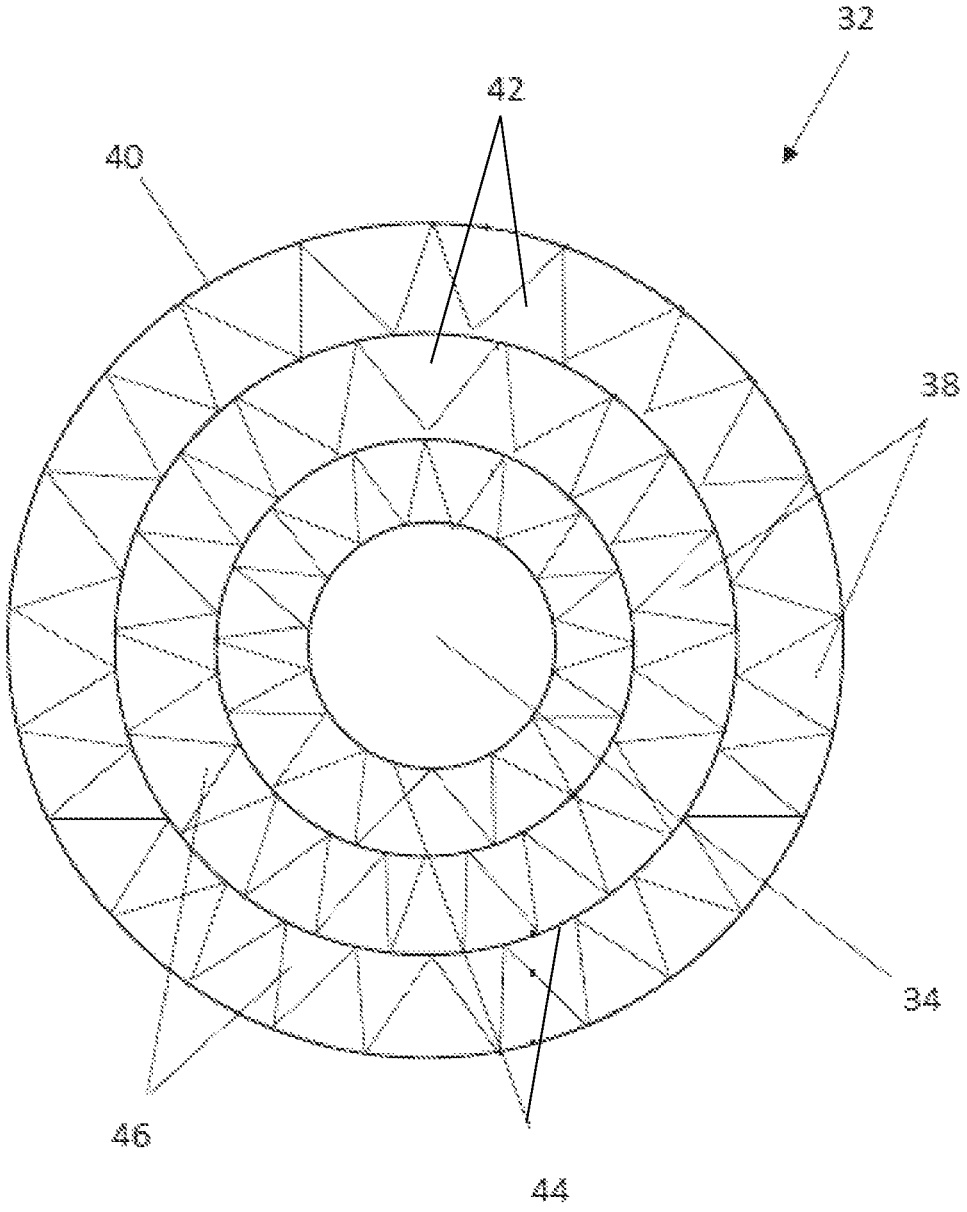
FIG. 3 is a cross-sectional view of an embodiment of a heat recovery wheel for a heat recovery ventilator.

Referring to the cross-sectional view of FIG. 3, the heat recovery wheel 32 includes a wheel outer rim 40 defining an outer perimeter of the heat recovery wheel 32. The plurality of wheel passages 38 are formed in one or more passage layers 42 arranged radially about the wheel axis 34. The passage layers 42 may be formed by generally circular elements, or may be formed in a spiral configuration about the wheel axis 34. The passage layers 42 are separated by a parting sheet 44, and wheel passages 38 of the same passage layers 42 are separated by passage fins 46.

Figure 4:
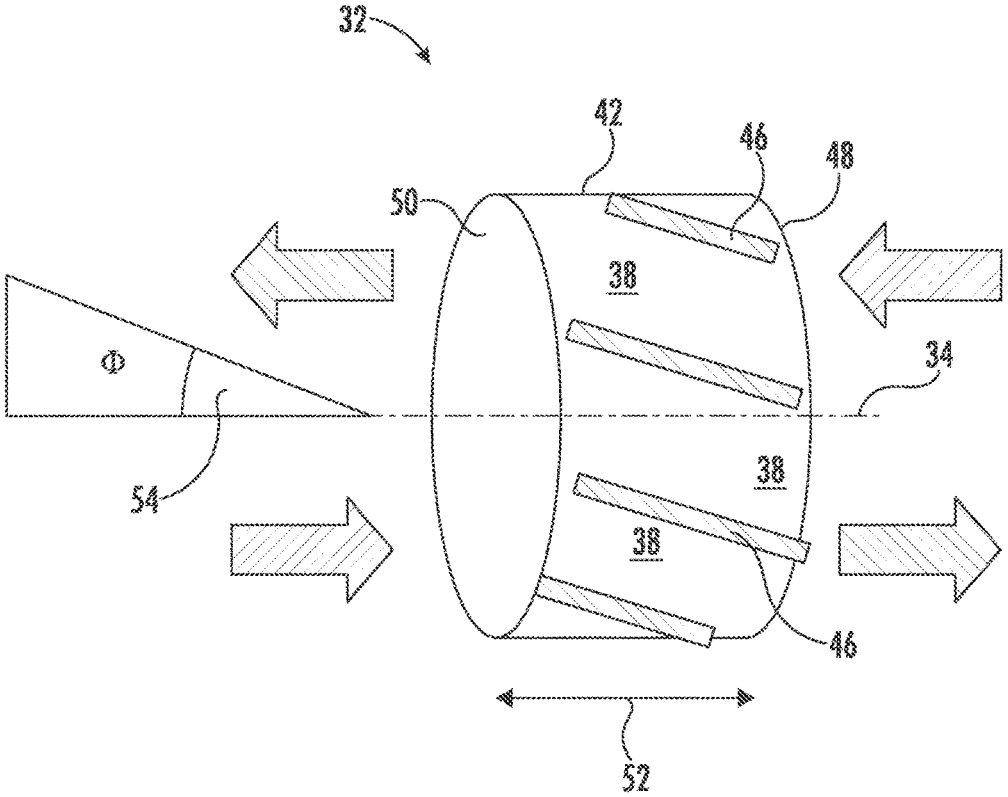
FIG. 4 is a schematic illustration of an embodiment of a passage fin configuration for a heat recovery ventilator.
Figure 5:
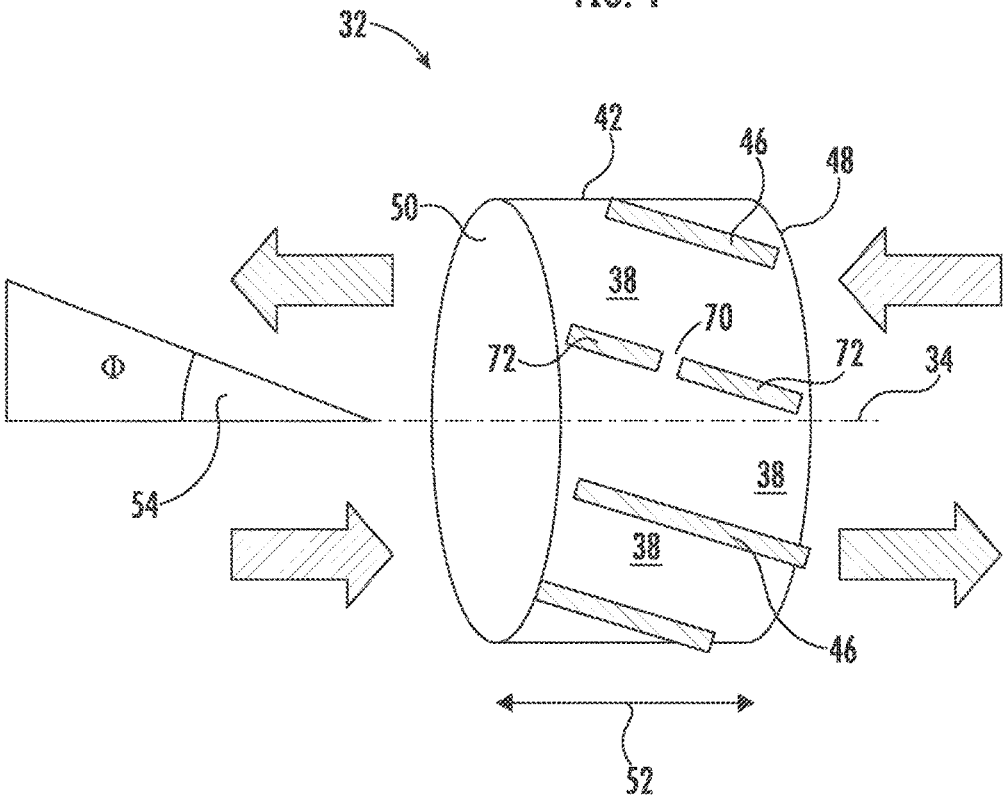
FIG. 5 is a schematic illustration of another embodiment of a passage fin configuration for a heat recovery ventilator.

Referring now to FIG. 4, the passage fins 46 extend from a first wheel end 48 to a second wheel end 50. In the heat recovery wheel 32, the passage fins 46 extend from the first wheel end 48 to the second wheel end 50 in a direction non-parallel to the wheel axis 34. This increases an effective wheel passage 38 length, compared to wall passages that are parallel to the wheel axis 34. This configuration improves heat transfer of the heat recovery wheel 32 for a selected heat transfer wheel length 52. While in the embodiment of FIG. 4, the passage fins 46 extend linearly at a fin angle 54 relative to the wheel axis 34, in other embodiments the passage fins 46 may extend, for example, curvilinearly from the first wheel end 48 to the second wheel end 50. Further, while in the embodiment of FIG. 4 the fin angle 54 is constant, in other embodiments the fin angle 54 may vary between the first wheel end and the second wheel end 50 to tune performance of the heat recovery wheel 32. Additionally, in some embodiments, the fin angle 54 may be different in adjacent passage layers 42 of the heat recovery wheel 32. Additionally, while continuous passage fins 46 are shown in FIG. 4, in other embodiments, such as shown in FIG. 5, the passage fins 46 may be segmented and discontinuous, with fin breaks 70 between adjacent fin segments 72.

Figure 6:
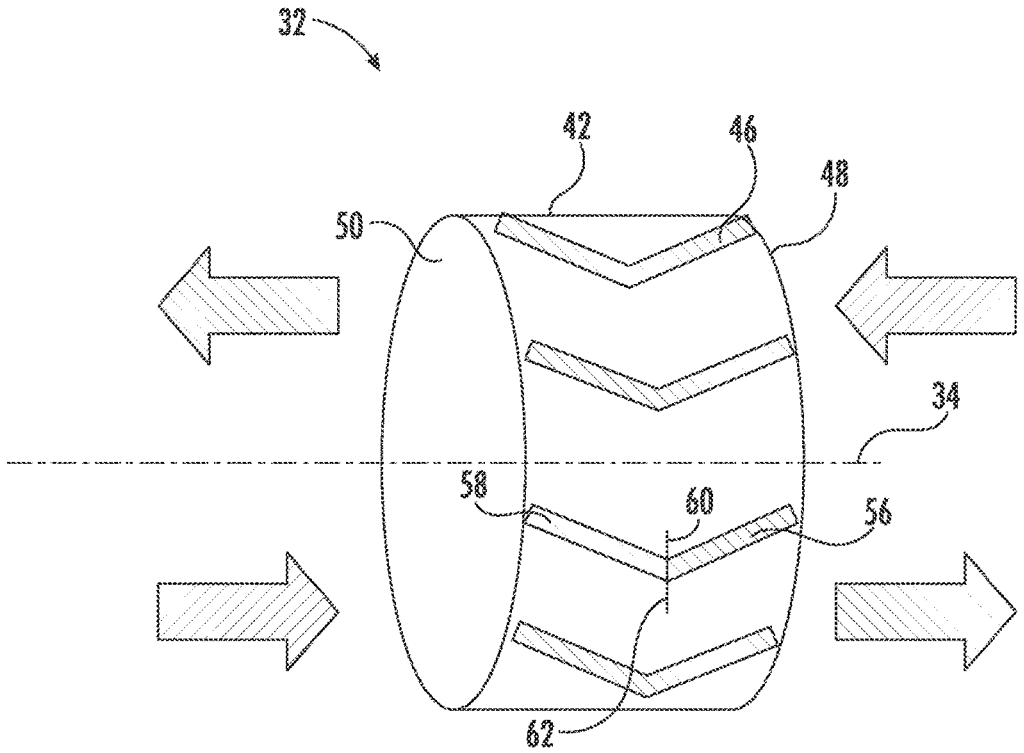
FIG. 6 is a schematic illustration of yet another embodiment of a passage fin configuration for a heat recovery ventilator.

Another embodiment of passage fin 46 configuration is illustrated in FIG. 6. In the embodiment of FIG. 6, the passage fin 46 has a chevron shape, with a first fin segment 56 extending from the first wheel end 48 at a first fin angle and a second fin segment 58 extending from the second wheel end 50 at a second fin angle. The first fin segment 56 and the second fin segment 58 meet at a fin peak 60, which is located at a wheel midpoint 62 when the first fin angle is equal to the second fin angle, forming a symmetric chevron-shaped passage fin 46. In other embodiments, the first fin angle is not equal to the second fin angle, thus resulting in an asymmetric passage fin 46. The chevron shape or configuration may vary between adjacent passage layers 42 of the heat recovery wheel 32. For example, in some embodiments the passage fins 46 may form chevron shapes extending in opposing directions in adjacent passage layers 42. Further, while in the embodiment of FIG. 6 the passage fin 46 has a single chevron shape between the first wheel end 48 and the second wheel end 50, in other embodiments the passage fin 46 may be a plurality of chevrons sequentially arranged between the first wheel end 48 and the second wheel end 50.

Figure 7:
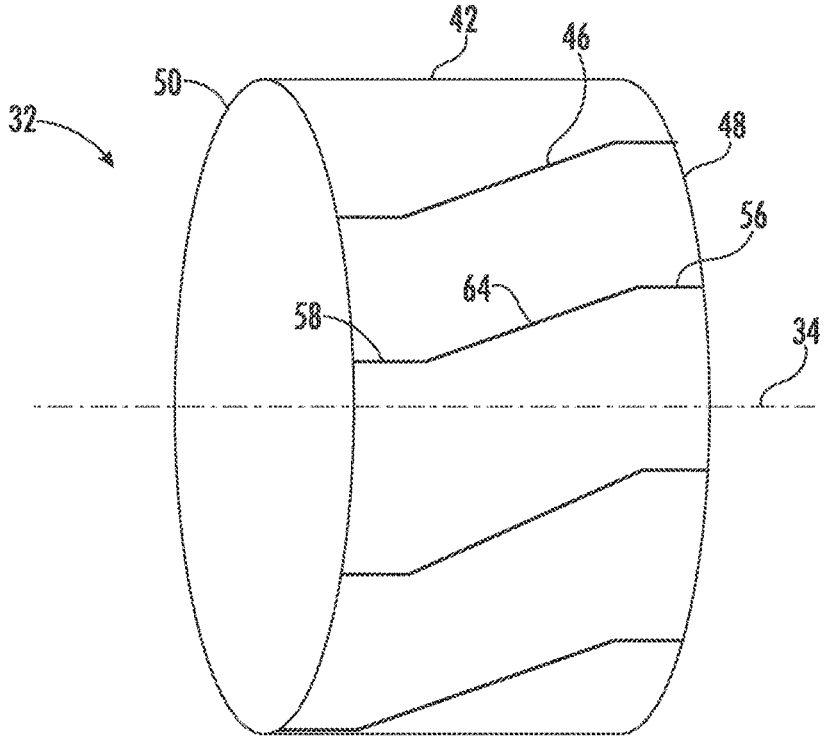
FIG. 7 is a schematic illustration of still another embodiment of a passage fin configuration for a heat recovery ventilator.

Another embodiment of passage fin 46 configuration is illustrated in FIG. 7. In the embodiment of FIG. 7, the passage fin 46 has a first fin segment 56 extending from the first wheel end 48 in a direction parallel to the wheel axis 34, and a second fin segment 58 extending from the second wheel end 50 in the direction parallel to the wheel axis 34. The first fin segment 56 is circumferentially offset from the second fin segment 58, and the first fin segment 56 is connected to the second fin segment 58 via a third fin segment 64 at a fin angle 54, not parallel to the wheel axis 34. Such a configuration increases the effective wheel passage 38 length, while also providing smooth transitions for the airflow entering and leaving the heat recovery wheel 32.

In some embodiments, the passage fins 46 may be textured to further enhance heat transfer, and/or may be coated with an adsorbent material for moisture control in the heat recovery ventilator 10. Additionally, the passage fins 46 may be coated with a hydrophobic and/or hydrophilic coatings to enhance moisture removal. The passage fins 46 may be formed from a metallic material, or alternatively may be formed from a polymer or a composite material.

The passage fins 46 and heat recovery wheel 42 of the present disclosure provides a solution to improve heat transfer of the heat recovery wheel 42 while maintaining a compact structure of the heat recovery wheel 42, and not increasing the length of the heat recovery wheel 42 to increase the performance. Further, the configurations of heat recovery wheel 42 disclosed herein reduces cross-stream mixing of the first airflow 24 and the second airflow 30.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A heat exchanger, comprising:

a housing, the housing defining:

a first airflow chamber through which a first airflow is directed; and a second airflow chamber through which a second airflow is directed; and a heat recovery wheel disposed in the housing and rotatable about a wheel axis, the heat recovery wheel including:

a wheel rim defining an outer perimeter of the heat recovery wheel; and a plurality of wheel passages located between the wheel rim and the wheel axis, the plurality of wheel passages at least partially defined by a plurality of passage fins, at least a portion of at least one passage fin of the plurality of passage fins extending non-parallel to the wheel axis between a first axial wheel end of the heat recovery wheel and a second axial wheel end of the heat recovery wheel;

wherein the plurality of wheel passages are configured for flow of the first airflow and the second airflow therethrough for thermal energy exchange between the first airflow and the second airflow;

wherein the at least one passage fin of the plurality of passage fins extends in a chevron shape from the first axial wheel end to the second axial wheel end, wherein when viewed from a circumferential side of the heat recovery wheel toward the wheel axis, the passage fin includes:

a first fin segment extending from the first axial wheel end at a first fin angle; and a second fin segment extending from the second axial wheel end at a second fin angle, the first fin segment and the second fin segment intersecting at a fin peak at an axial midpoint of the heat recovery wheel to define a groove;

wherein the plurality of wheel passages are arranged in a plurality of circumferentially-extending layers from the wheel axis to the wheel rim, radially adjacent layers separated by a circumferentially-extending parting sheet.

2. A heat recovery wheel for a heat exchanger, comprising:

a wheel rim defining an outer perimeter of the heat recovery wheel; and a plurality of wheel passages located between the wheel rim and a wheel axis, the plurality of wheel passages at least partially defined by a plurality of passage fins, at least a portion of at least one passage fin of the plurality of passage fins extending non-parallel to the wheel axis between a first axial wheel end and a second axial wheel end;

wherein the plurality of wheel passages are configured for flow of a first airflow and a second airflow therethrough for thermal energy exchange between the first airflow and the second airflow;

wherein the at least one passage fin of the plurality of passage fins extends in a chevron shape from the first axial wheel end to the second axial wheel end, wherein when viewed from a circumferential side of the heat recovery wheel toward the wheel axis, the passage fin includes:

a first fin segment extending from the first axial wheel end at a first fin angle; and a second fin segment extending from the second axial wheel end at a second fin angle, the first fin segment and the second fin segment intersecting at a fin peak at an axial midpoint of the heat recovery wheel to define a groove;

wherein the plurality of wheel passages are arranged in a plurality of circumferentially-extending layers from the wheel axis to the wheel rim, radially adjacent layers separated by a circumferentially-extending parting sheet.

3. The heat recovery wheel of claim 2, wherein passage fins of a first layer of the plurality of layers are non-parallel to passage fins of a radially adjacent second layer of the plurality of layers.

4. The heat recovery wheel of claim 2, wherein the plurality of passage fins are textured to enhance thermal energy transfer.

5. The heat recovery wheel of claim 2, wherein the plurality of passage fins are coated with one or more of an adsorbent, a hydrophobic coating or a hydrophilic coating.

6. The heat recovery wheel of claim 2, wherein the plurality of passage fins are formed from a metal, a polymer or a composite material.

* * * * *